US012617577B2

(12) United States Patent
Oh

(10) Patent No.: US 12,617,577 B2
(45) Date of Patent: May 5, 2026

(54) FOOD CONTAINER

(71) Applicant: KAYU PACKAGE K.K., Tokyo (JP)

(72) Inventor: Katsufumi Oh, Tokyo (JP)

(73) Assignee: KAYU PACKAGE KK, Tokyo (JP)

( * ) Notice: Subject to any disclaimer, the term of this patent is extended or adjusted under 35 U.S.C. 154(b) by 0 days.

(21) Appl. No.: 18/003,541

(22) PCT Filed: Nov. 4, 2021

(86) PCT No.: PCT/JP2021/040552
§ 371 (c)(1),
(2) Date: Dec. 28, 2022

(87) PCT Pub. No.: WO2022/113681
PCT Pub. Date: Jun. 2, 2022

(65) Prior Publication Data

US 2023/0249868 A1 Aug. 10, 2023

(30) Foreign Application Priority Data

Nov. 30, 2020 (JP) ..... 2020-198310

(51) Int. Cl.
*B65D 3/06* (2006.01)
*B65D 3/04* (2006.01)
(Continued)

(52) U.S. Cl.
CPC ..... *B65D 3/06* (2013.01); *B65D 3/04* (2013.01); *B65D 5/32* (2013.01); *B65D 21/0215* (2013.01); *B65D 21/0233* (2013.01); *B65D 25/24* (2013.01)

(58) Field of Classification Search
CPC ... B65D 3/06; B65D 3/04; B65D 5/32; B65D 21/0215; B65D 21/0233; B65D 25/24;
(Continued)

(56) References Cited

U.S. PATENT DOCUMENTS 2,917,215 A * 12/1959 Psaty ..... B65D 3/22 229/400
3,268,143 A * 8/1966 Bolcato ..... B65D 3/14 D7/523
(Continued)

FOREIGN PATENT DOCUMENTS

GB 2504166 A * 1/2014 ..... B32B 27/10
JP S53-72648 U1 11/1976
(Continued)

*Primary Examiner* — Christopher R Demeree
(74) *Attorney, Agent, or Firm* — WCF IP

(57) ABSTRACT

An erectable-type container having excellent durability is provided.
The container 1 includes a bottom part 11, a side part 12 forming a box-shaped storage 1*a* with the bottom part 11, and a cross section appearing on a periphery 11*a* of the bottom part 11 is sealed with an insoluble sealing material which prevents moisture infiltration, and the side part 12 is adhered to the bottom part 11 by adhesive or the sealing material interposed between the cross section appearing on the periphery 11*a* of the bottom part 11. Further, the bottom part 11 is circular; and the side part is annular. Furthermore, the side part 12 is formed by engaging a belt-shaped body having an engagement protrusion 121 on one end and an engagement recess 122 on another end.

6 Claims, 8 Drawing Sheets

(51) Int. Cl.
*B65D 5/32* (2006.01)
*B65D 21/02* (2006.01)
*B65D 25/24* (2006.01)

(58) Field of Classification Search
CPC ..... B65D 21/022; B65D 9/02; B65D 9/32; B65D 3/14; B65D 3/28; B65D 3/12; B65D 7/34; B65D 81/3865; B65D 7/38; B32B 2439/70; B32B 27/10
USPC ..... 229/104, 400, 403, 4.5, 198.2, 5.5, 919; 220/614, 619, 62.12, 62.2, 678
See application file for complete search history.

(56) References Cited

U.S. PATENT DOCUMENTS 3,409,168 A * 11/1968 Chmielowiec ..... B65D 7/34 220/619
4,211,339 A * 7/1980 Itoh ..... B29C 65/4815 229/400

FOREIGN PATENT DOCUMENTS

| | | | |
|---|---|---|---|
| JP | 2006-348498 | A | 12/2006 |
| JP | 3133835 | U | 7/2007 |
| JP | 2008-37500 | A | 2/2008 |
| JP | 3152979 | U | 8/2009 |
| JP | 2011-164455 | A | 6/2011 |
| JP | 3181568 | U | 2/2013 |
| JP | 5508065 | B2 | 5/2014 |
| JP | 2016-000922 | A | 1/2016 |

* cited by examiner

FOOD CONTAINER

TECHNICAL FIELD

The present invention relates to a container suitable for storing food and the like.

BACKGROUND ART

Conventionally, as illustrated in Patent Literature 1 and Patent Literature 2, erectable-type containers have been provided.

Since the erectable-type containers can be kept compact until use, it is convenient without being bulky in transportation, inventory management and the like.

CITATION LIST

Patent Literature

Patent Literature 1: JP 2011-116455 A
Patent Literature 2: JP 3133835 U

SUMMARY OF INVENTION

Technical Problem

However, when food is placed in the container, moisture and oil tend to seep out of the container from a joint of a member since most of the foods contain moisture and oil. Therefore, there is a demand for a container that can preventing the moisture and oil contained in contents from seeping out or leaking out of the container.

Thus, an object of the present invention is to provide an erectable-type container having excellent, durability.

Solution to Problem

A food container according to the present invention includes a bottom part, and a side part forming a box-shaped storage with the bottom part, and a cross section appearing on a periphery of the bottom part is sealed with an insoluble sealing material which prevents moisture infiltration, and the side part is adhered to the bottom part by adhesive or the sealing material interposed between the cross section appearing on the periphery of the bottom.

Further, the bottom part may be circular, and the side part may be annular.

Further the side part may be formed by engaging a belt-shaped body having a first engagement on one end and a second engagement on another end.

Further, the first engagement and the second engagement may be adhered at a part to engage by an adhesive.

Further, the side part may be tapered so as to expand a diameter in a direction opposite to the bottom part.

Further, the container may be made of a woody material.

The side part may be adhered to the bottom part so that a fiber direction of the woody material is parallel to the bottom part.

Effect of the Invention

According to the container of the present invention, even the food or the like containing water or oil is stored, the water or oil of the food does not seep out or leak out of the container, and the container has excellent durability.

PREFERRED EMBODIMENT

First Embodiment

A container according to an embodiment of the present invention will be described below with reference to the drawings.

Figure 1:
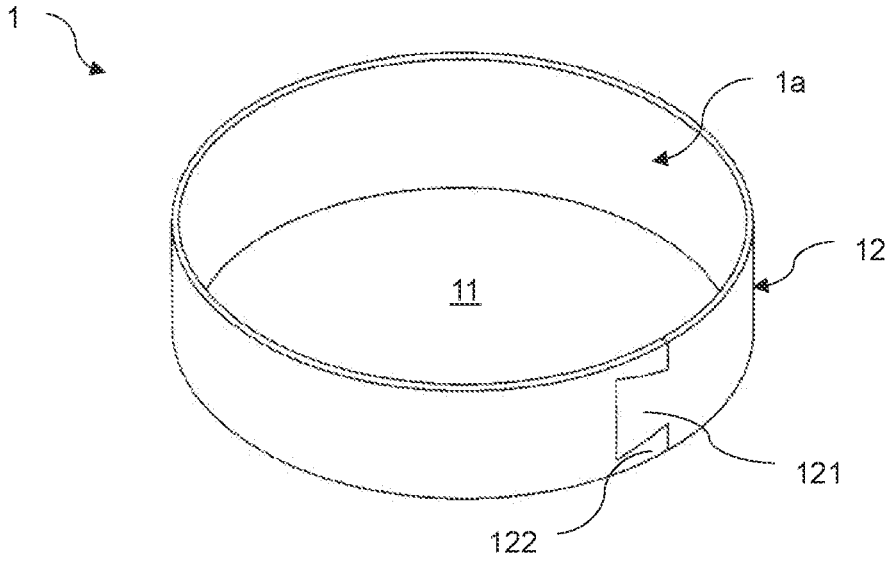
FIG. 1 is an external perspective view illustrating a container according to a first embodiment of the present invention.
Figure 2:
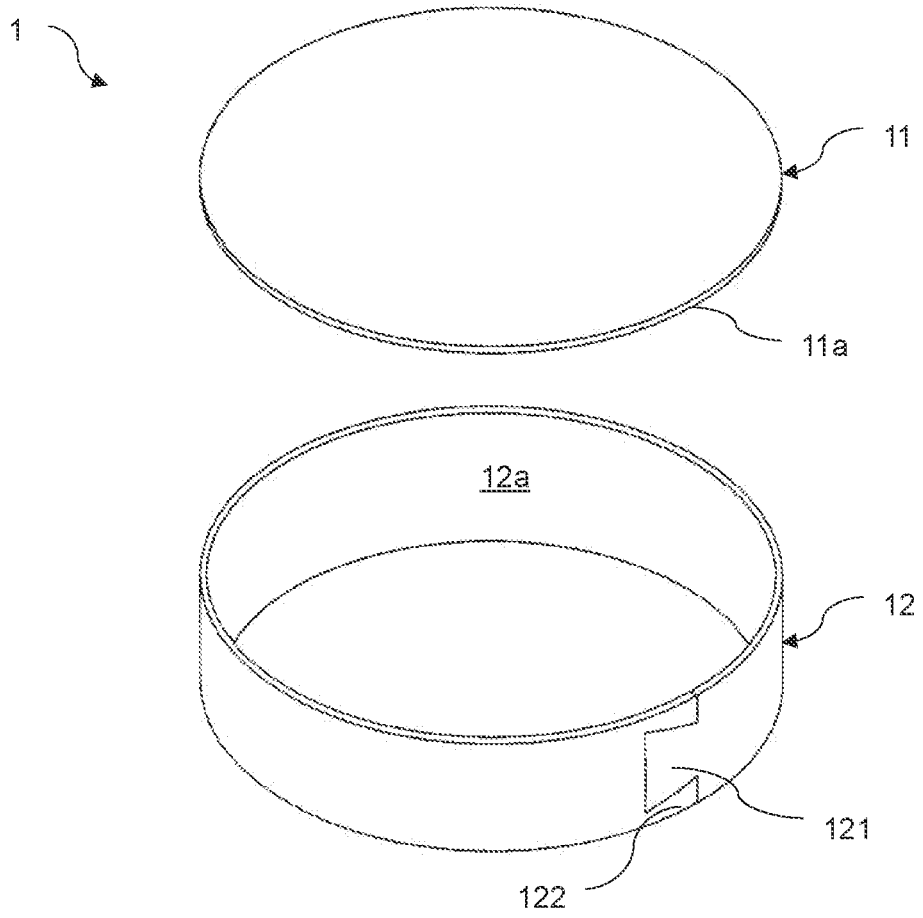
FIG. 2 is an exploded perspective view illustrating a container according to a first embodiment of the present invention.

As illustrated in FIG. 1 and FIG. 2, the container according to a first embodiment of the present invention includes a bottom part 11 and a side part 12, bonded to each other. The bottom part 11 and the side part 12 forms a concave storage 1*a* having an upper opening, and contents such as food and the like are contained in the storage 1*a*.

The bottom part 11 is a circular bottom plate and forms a box-shaped storage 1*a* with the side part 12.

The bottom part 11 has a thickness capable of withstanding a weight of contents such as food stored in the storage 1*a*.

Further, the bottom part 11 may be formed by a single flat plate-like bottom plate, or may be formed by stacking a plurality of bottom plates.

The side part 12 forms the box-shaped storage 1*a* with the bottom part 11.

This side part 12 is a belt-shaped body having an engagement protrusion 121 as a first engagement on one end and an engagement recess 122 as a second engagement on another end. By engaging the engagement protrusion 121 with the engagement recess 122, while bending entirely, the side part 12 is formed into an annular or cylindrical shape.

As described below, the side part 12, for example, is made of woody material and has flexibility. Thus, when the engagement protrusion 121 and the engagement recess 122 are not engaged with each other, it can be stored as a flat belt-like member. On the other hand, when it is erected to be used, it can be entirely bent to form an annular shape so that the engagement protrusion 121 is engaged with the engagement recess 122.

Among circular openings formed at upper and lower ends by the side part 12 formed in the annular shape, at least the opening on a side where the bottom part 11 is attached has the same diameter as that of the bottom part 11. As a result, one end side of the opening of the side part 12 is closed by the bottom part 11 without any gap.

Shapes of the engagement protrusion 121 and the engagement recess 122 are not particularly limited and other shapes may be used.

Further, since an engaged part of the engagement protrusion 121 and the engagement recess 122 may be adhered by an adhesive, seeping and leaking of the moisture and the like from the engaged part can be prevented as a result.

Figure 3:
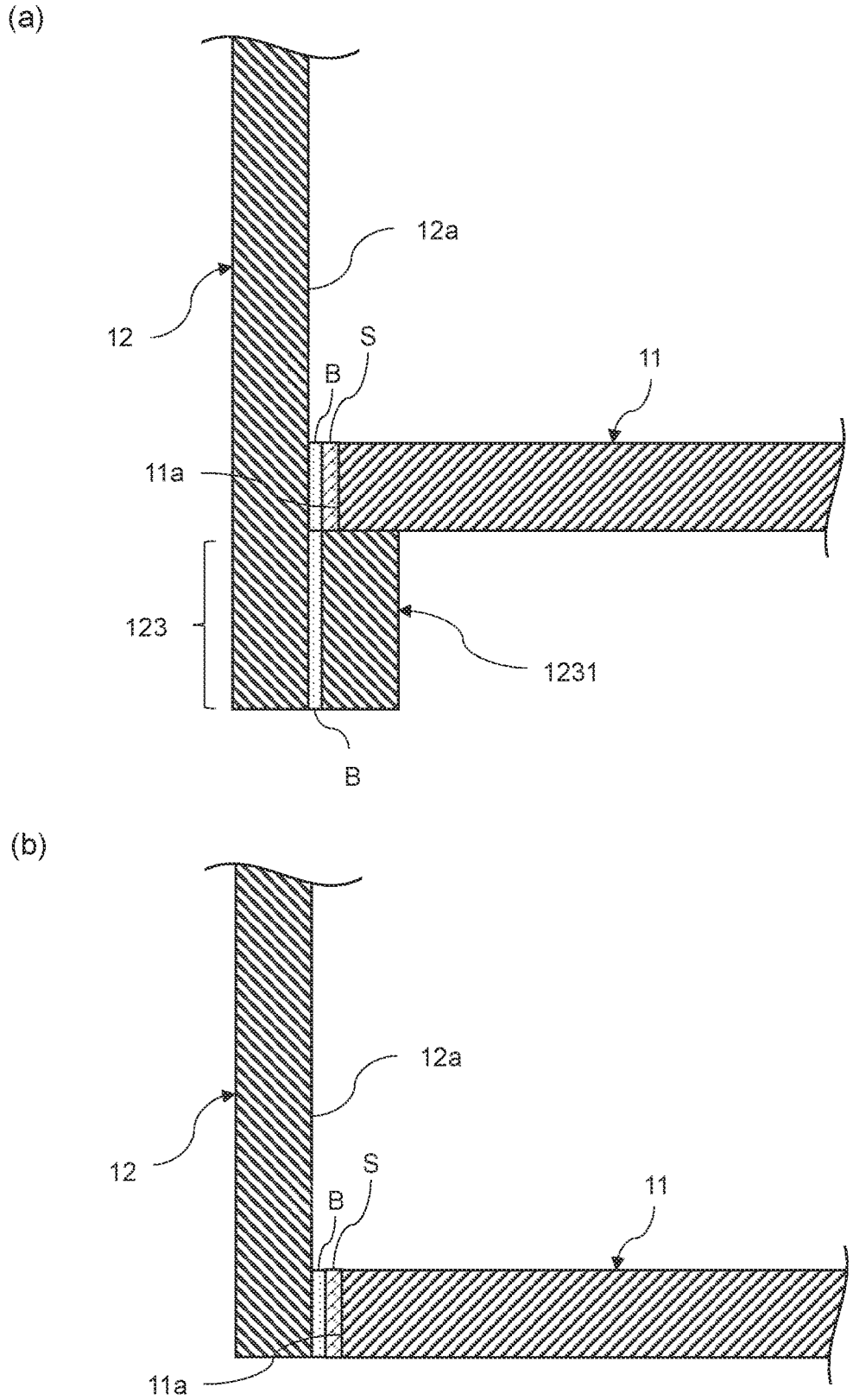
FIG. 3 is a partially enlarged view schematically illustrating a joint part of a container according to a first embodiment of the present invention.

As illustrated in FIG. 3(*a*), the side part 12 protrudes slightly downward from the bottom part 11, and a part protruding forms a leg part 123. In the present embodiment, a reinforcing piece 1231 to reinforce the leg part 123 is adhered from inside.

As a result of a provision of the leg part 123, when the container 1 is placed on a platform, such as a table, the leg part 123 comes into contact with the platform and the bottom part 11 does not come into contact with the platform.

Figure 4:
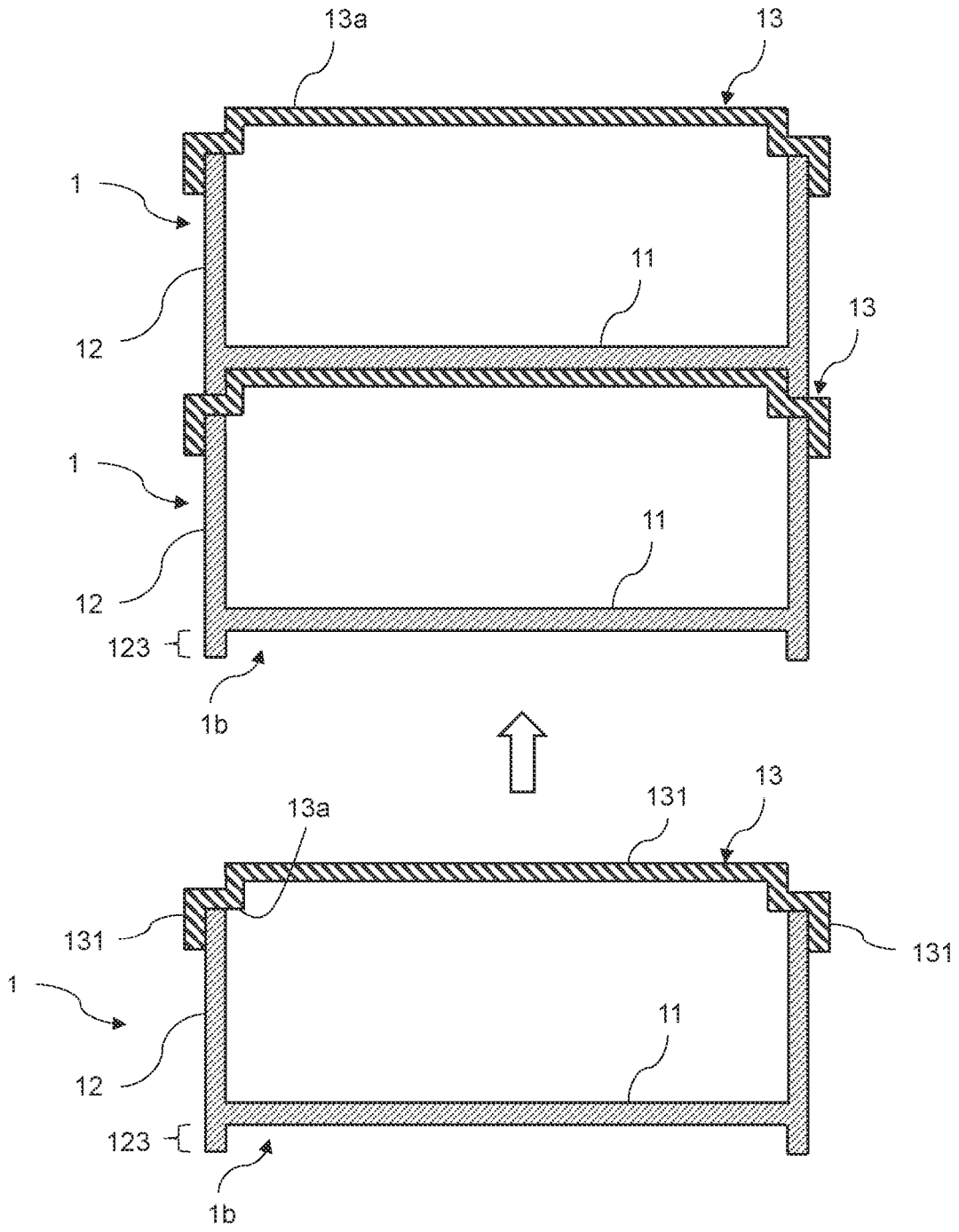
FIG. 4 is a cross-sectional view illustrating a state in which containers according to a first embodiment of the present invention are covered with lids and stacked.

The leg part 123 is suitable for use with a lid 13, as illustrated in FIG. 4, placed on the container 1. In other words, a circular fitting recess 1*b* is formed inside of the leg part 123. On the other hand, a fitting protrusion 13*a* projecting upward is provided above the lid 13 in accordance with a shape of the circular fitting recess 1*b*. When a plurality of the containers 1 are stacked with the lid covers the container 1, the fitting recess 1*b* fits to the fitting protrusion 13*a*. As a result, when the containers 1 are stacked, the stacked containers 1 do not slide down side ways, and it is convenient not to collapse when carried or stored in a stacked state.

The container 1 can be made of various materials, but in the present embodiment, both the bottom part 11 and the side part 12 are constituted by woody materials.

Since they are constituted by woody materials, a thin side part 12 has flexibility and can be annularly bent to engage the engagement protrusion 121 with the engagement recess 122. In addition, a person who picks up the container 1 can be given an environment-friendly and soft atmosphere.

On the other hand, when they are constituted by woody materials, moisture is easily infiltrated from the cross section of the woody material in the fiber direction. In other words, the moisture is likely to infiltrate from the periphery 11*a* of the bottom part 11. Therefore, as illustrated in FIG. 3(*a*), the cross section appearing on the periphery 11*a* of the bottom part 11 is sealed with an insoluble or water-repellent sealing material S which is not soluble in water. The sealing material S may be, for example, an acrylic resin. By sealing the cross section of the woody material in this manner, it is possible to effectively prevent moisture, oil or the like, of the food as the contents from seeping into the bottom part 11

Regardless of the example illustrated in FIG. 3(*a*), the cross section appearing in a width direction of the side part 12 may be sealed with the sealing material S.

Moreover, the side part 12 is preferably provided so that the fiber direction of the woody material is parallel to the bottom part 11. In the present embodiment, a longitudinal direction of the side part 12 and the fiber direction of the woody material are matched.

As a result, moisture or the like contained in the contents of the food or the like is prevented from seeping into joint parts between the bottom part 11 and the side part 12 along the fiber direction, and durability can be ensured.

As illustrated in FIG. 3(*a*), the side part 12 is adhered to the bottom part 11 by an adhesive B interposed between an inner peripheral surface 12*a* and the periphery 11*a* of the bottom part 11, which is a thick part of the bottom part 11. When the bottom part 11 and the side part 12 are adhered to each other, the side part 12 stands substantially perpendicular to the bottom part 11. An adhered part is a position biased to the one end side of the opening among the inner peripheral surface 12*a* of the side part 12, thereby the storage 1*a* is formed.

The periphery 11*a* of the bottom part 11 is sealed by the sealing material S, and the adhesive B is adhered to the sealing material S. However, since the sealing material S itself, such as an acrylic resin, has adhesiveness, the periphery 11*a* of the bottom part 11 can be sealed by the sealing material S without using the adhesive B separately from the sealing material S, and the bottom part 11 can be adhered to the side part 12. In addition, a water-repellent or insoluble material is preferably used for the adhesive B in a similar manner as the sealing material S.

Further, in the example of FIG. 3(*a*), the periphery 11*a* of the bottom part 11 is adhered to a part slightly inside from an end of the width direction among the inner peripheral surface 12*a* of the side part 12 and the leg part 123 is provided. However, as illustrated in FIG. 3(*b*), if the leg part 123 is not provided, the periphery 11*a* of the bottom part 11 can be adhered to the end of the width direction among the inner peripheral surface 12*a* of the side part 12.

When the side part 12 and the bottom part 11 are adhered, for example, the adhesive is applied to the periphery 11*a* of the bottom 11 whose periphery 11*a* is sealed by the sealing material S in advance. Then, the side part 12 in which the engagement protrusion 121 and the engagement recess 122 are not engaged is wrapped around the periphery 11*a* of the bottom part 11 to adhere the inner peripheral surface 12*a* of the side part 12, and the engagement protrusion 121 and the engagement recess 122 are engaged. When the side part 12 is wrapped around the periphery 11*a* of the bottom part 11 to adhere, the storage 1*a* is formed so that the bottom part 11 is adhered to a place biased to one end side of the opening among the inner peripheral surface 12*a* of the side part 12.

Types of the adhesive are not particularly limited, but it is preferable to use the adhesive which does not affect the contents of the food.

According to the container 1 of the present embodiment, even when the food or the like including moisture and oil is stored in the storage 1*a*, moisture and oil of the food or the like does not seep out or leak out of the container and is excellent in durability. In particular, moisture or the like in the contents of the food or the like tends to seep out from the joint part between the bottom part 11 and the side part 12, but since the periphery 11*a* of the bottom part 11 and the inner peripheral surface 12*a* of the side part 12 are adhered with the adhesive, moisture does not easily accumulate and seep out, and it demonstrates higher durability.

A thin waterproof film or sheet may be laminated on surfaces of the bottom part 11 and the side part 12, particularly on a surface contact with the contents. Thereby, this can prevent moisture and oil from permeating from the surfaces of the bottom part 11 and the side part 12.

Second Embodiment

Figure 5:
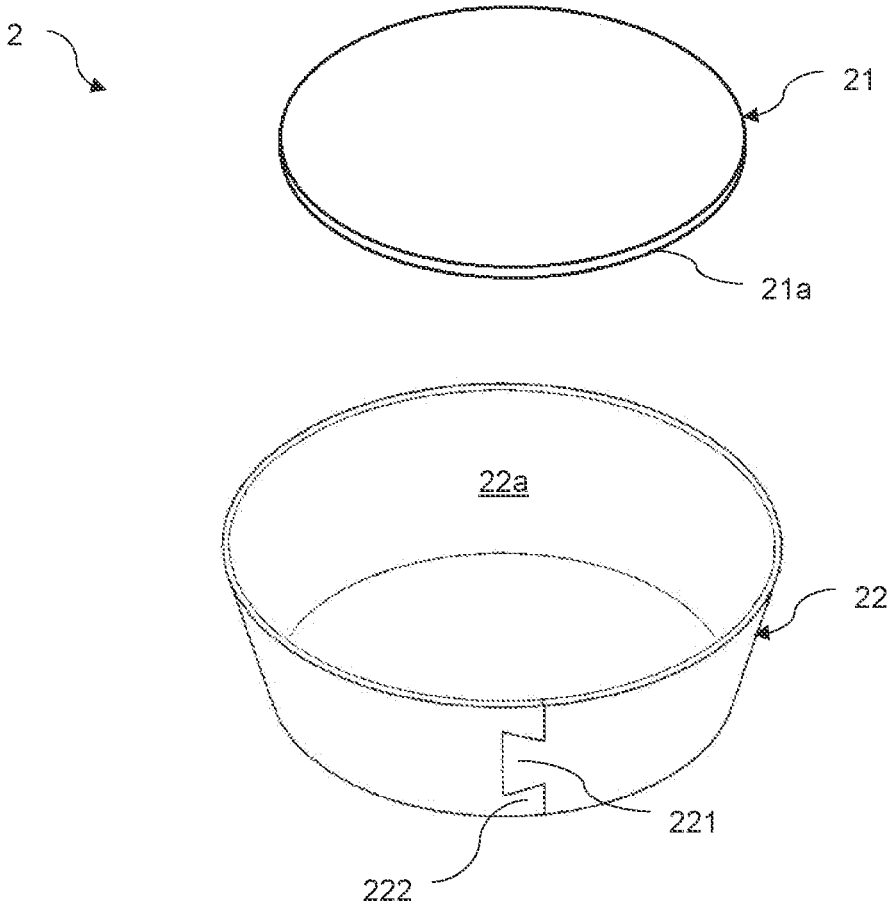
FIG. 5 is an exploded perspective view illustrating a container according to a first embodiment of the present invention.
Figure 6:
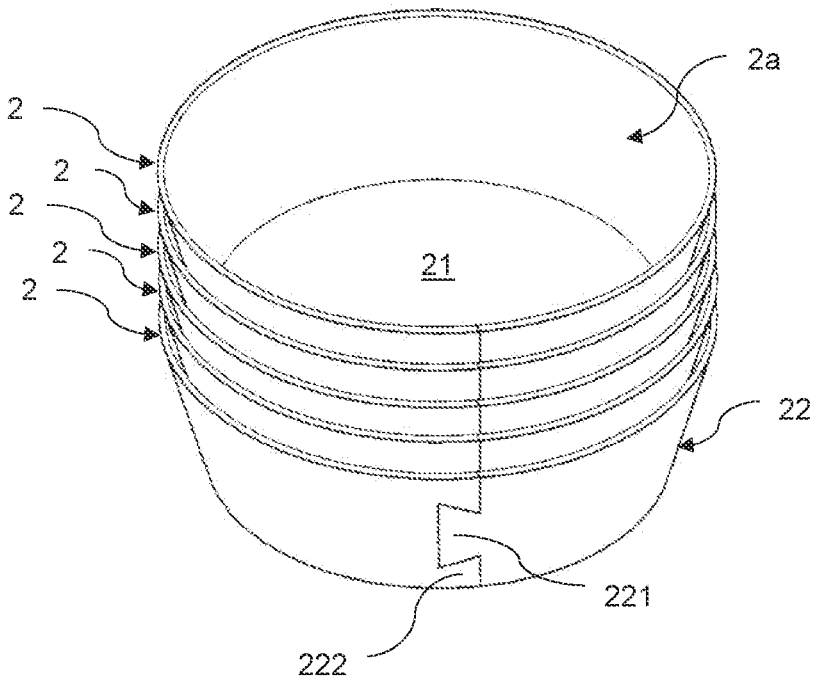
FIG. 6 is an external perspective view illustrating a state in which containers according to a second embodiment of the present invention are stacked.

FIG. 5 and FIG. 6 illustrates a container 2 according to a second embodiment of e present invention.

As in the case of the container 1., the container 2 includes a bottom part 21 and a side part 22, and the bottom part 21 and the side part. 22 adhered to each other form a storage 2*a* for storing the contents. The container 2 also has the same structure as the container 1 at following points that it has a leg part 223 reinforced by a reinforcing piece 2231, the side part 22 is engaged with an engagement protrusion 221 and an engagement recess 222, and it is made of woody material.

In this embodiment, the side part 22 is provided with a taper so that its diameter expands in a direction opposite to the bottom part 21. In other words, the side part 22 opening at both ends has a larger diameter of an opening on an opposite side than a diameter of an opening where the bottom part 11 is attached.

Therefore, the storage 2*a* of one container 2 can store other containers 2 by stacking a plurality of the containers 2. As a result, even when the bottom part 21 and the side part 22 are adhered to be erected, it is not bulky to store the container 2 as a stock or transport the container 2.

Figure 7:
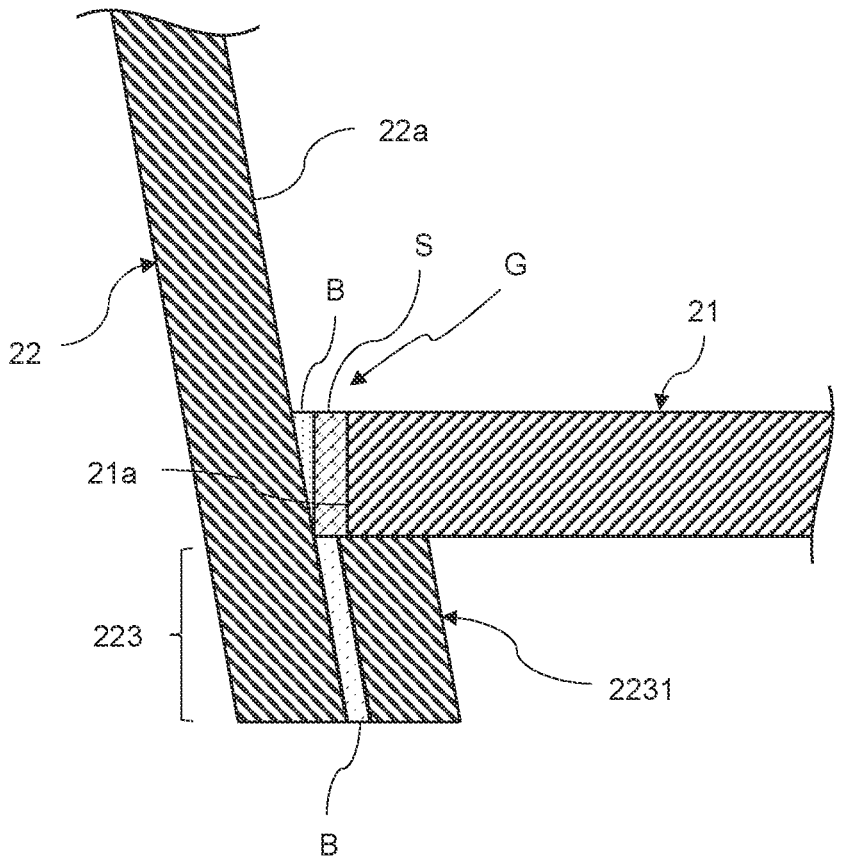
FIG. 7 is a partially enlarged view schematically illustrating a joint part of a container according to a second embodiment of the present invention.
Figure 8:
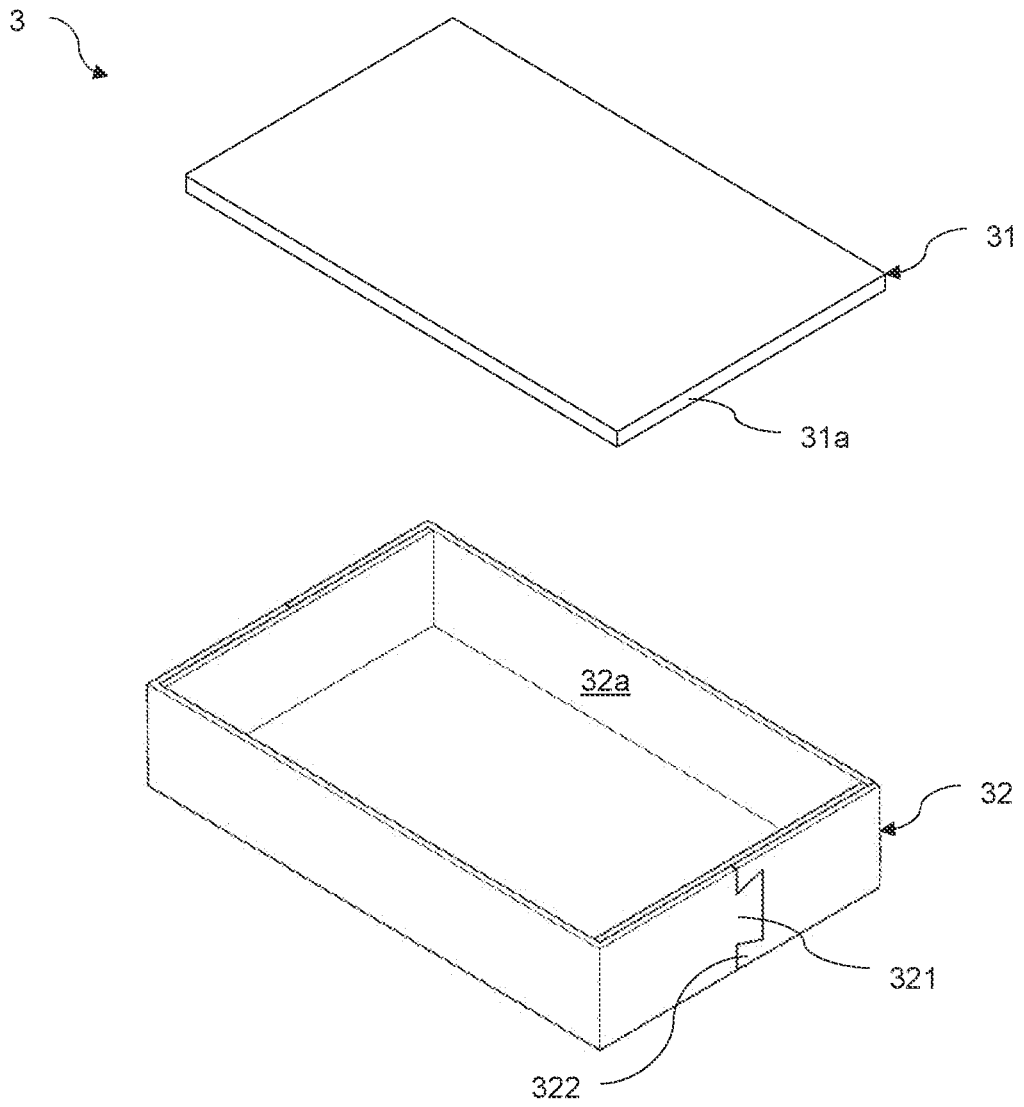
FIG. 8 is an exploded perspective view illustrating a container according to a third embodiment of the present invention.

As illustrated in FIG. 7, in the container 2, a periphery 21*a* of the bottom part 21 is also sealed by the sealing material S, and an inner peripheral surface 22*a* of the side part 22 is adhered to the periphery 21*a* of the bottom part 21.

As a result of tapering the side part 22 of the container 2, a substantially V-shaped groove part G is formed between the side part 22 and the bottom part 21, having a constant thickness. In this embodiment, the adhesive B is applied so as to fill at least this groove part G, the bottom part 21 and the side part 22 are adhered, and the groove part G is filled, so that it is possible to avoid leaving a dent where moisture, oil, and the like, is easily accumulated at a joint part of the bottom part 21 and the side part 22. As a result, even in the container 2 having the side part 22 tapered, it is also possible to prevent that a cross section of the bottom part 21 appears, and the moisture and the like seeps out or leaks out from the joint part of the bottom part 21 and the side part 22.

The container 2 according to the second embodiment may be provided with a lid similar to the lid 13 of the first embodiment in accordance with the shape of the container 2. In addition, the surface of the bottom part 21 and the side part 22 may be laminated with a waterproof sheet or film.

Third Embodiment

The containers 1 and 2 according to the present embodiments described above have circular bottom parts 11 and 21, and the containers 1 and 2 themselves are substantially cylindrical with one end closed, but the bottom part may be in shapes such as a rectangular shape, an oval shape, or a polygonal shape, in other embodiments.

As an example, FIG. 13 illustrates a container 3 having a rectangular shaped bottom part 31. This container 3 is constituted with the rectangular shaped bottom part 31 and a rectangular frame shaped side part 32.

The side part 32 is a belt-shaped body having an engagement protrusion 321 as a first engagement on one end and an engagement recess 322 as a second engagement on another end. By bending at appropriate parts according to the shape of the bottom part 31 and engaging the engagement protrusion 321 with the engagement recess 322, the side part 32 is formed as a rectangular frame shape.

This side part 32 is adhered to the bottom part 31 by the adhesive B interposed between a periphery 31*a* of the bottom part 31, which is a thick part of the bottom part 31. An adhered part is a position biased to the one end side of the opening among an inner peripheral surface 32*a* of the side part 32, thereby the storage storing the contents is formed.

The container 3 may also be made of a woody material in the same manner as the container 1. A joint part of the engagement protrusion 321 and the engagement recess 322 may be adhered by an adhesive. Further, a taper may be applied to be stackable, or a lid in accordance with the shape of the container 3, which is similar to the lid 13, may be used. In addition, the surface of the bottom part 31 and the side part 32 may be laminated with a waterproof sheet or film.

REFERENCE SIGNS LIST

1 container
11 bottom part
11*a* periphery
12 side part
12*a* inner peripheral surface
121 engagement protrusion
122 engagement recess
123 leg part
2 container
21 bottom part
21*a* periphery
22 side part
221 engagement protrusion
222 engagement recess
223 leg part
3 container
31 side part
31*a* periphery
32 side part
32*a* inner peripheral surface
321 engagement protrusion
322 engagement recess
B adhesive
S sealing material
G groove part

The invention claimed is:

1. A food container comprising:

a bottom part comprising a top, a bottom, and an outer peripheral edge, wherein the bottom part is flat and extends to the outer peripheral edge of the bottom part; and a side part forming a storage with the bottom part;

wherein a cross section of the outer peripheral edge of the bottom part is sealed with an insoluble sealing material which prevents moisture infiltration, wherein the insoluble material is flush with the top of the bottom part, wherein the side part is adhered to the bottom part with the insoluble sealing material interposed between the cross section of the outer peripheral edge of the bottom part and the side part, wherein the container is made of wood material, and wherein the side part is adhered to the bottom part so that a fiber direction of the wood material in the side part is parallel to a fiber direction of the wood material in the bottom part.

2. The food container according to claim 1, wherein the bottom part is circular, and the side part is annular.

3. The food container according to claim 1, wherein the side part is formed by engaging a belt-shaped body having a first engagement on one end and a second engagement on another end.

4. The food container according to claim 3, wherein the first engagement and the second engagement are adhered at a part to engage by an adhesive.

5. The food container according to claim 1, wherein the side part is formed from a plurality of side parts, wherein the side part is tapered so as to expand a diameter in a direction opposite to the outer peripheral edge of the bottom part, and an adhesive is filled in a substantially V-shaped gap formed between adjacent pairs of the plurality of side parts adhered to each other and the cross section of the periphery of the bottom part.

6. The food container according to claim 1, wherein the side part protrudes below the bottom part, and protruding part constitutes a leg part.

* * * * *